US005142958A

United States Patent [19]

Nordlin et al.

[11] Patent Number: 5,142,958

[45] Date of Patent: Sep. 1, 1992

[54] CUTTER FOR DIN RAIL

[75] Inventors: William F. Nordlin; Billy J. Bauscher, both of Rockford, Ill.

[73] Assignee: Greenlee Textron Inc., Rockford, Ill.

[21] Appl. No.: 609,253

[22] Filed: Nov. 5, 1990

[51] Int. Cl.[5] ..... B21D 28/24; B23D 23/00; B26D 5/02

[52] U.S. Cl. ..... 83/559; 83/620; 83/640; 83/685; 83/694; 83/699

[58] Field of Search ..... 83/559, 620, 640, 641, 83/682, 685, 690, 694, 698, 699

[56] References Cited

U.S. PATENT DOCUMENTS

| | | | |
|---|---|---|---|
| 2,600,834 | 6/1952 | Blair | 83/620 X |
| 3,137,193 | 6/1964 | Whistler, Sr. et al. | 83/685 |
| 3,564,893 | 2/1971 | Richards et al. | 83/620 X |
| 3,678,724 | 7/1972 | Stone et al. | 83/694 X |
| 3,741,573 | 6/1973 | Treer | 83/698 X |
| 3,892,158 | 7/1975 | Smeets | 83/640 X |
| 4,012,934 | 3/1977 | Stone et al. | 83/694 X |
| 4,457,197 | 7/1984 | Wepner et al. | 83/620 X |
| 4,532,845 | 8/1985 | Jinnouchi | 83/559 X |
| 4,907,481 | 3/1990 | Dvorak et al. | 83/699 X |

FOREIGN PATENT DOCUMENTS

| | | | |
|---|---|---|---|
| 47-19839 | 6/1972 | Japan | 83/559 |

OTHER PUBLICATIONS

IMB Multifor Din Rail Cutter Nos. 9050, 9053 and 9055 (three pages).

*Primary Examiner*—Frank T. Yost

*Assistant Examiner*—Eugenia A. Jones

*Attorney, Agent, or Firm*—Trexler, Bushnell, Giangiorgi & Blackstone, Ltd.

[57] ABSTRACT

A DIN rail cutter and punching apparatus for cutting a DIN rail to a selected length and for punching at least one mounting slot therethrough at a desired angular orientation comprises a shear for cutting the DIN rail and a punch and die set which is operatively coupled for operation in unison with the shear. The DIN rail cutter comprises a shear for cutting the DIN rail and is arranged for removably receiving a cutting die for accommodating any of a plurality of cutting dies for cutting different shapes of DIN rail. A rotating punch and die set for punching a DIN rail at any of a plurality of angular orientations comprises a punch mounting block; a punch rotatably mounted in the punch mounting block; a die mounting block and a die rotatably mounted in the die mounting block; the punch mounting block and the die mounting block are mounted for relative movement so as to advance and retract the punch into an out of engagement with the die. An interlocking member releasably interlocks with the die for preventing rotation thereof. A release arrangement releases the interlocking member in response to advancement of the punch into engagement with the die such that rotation of the die can only be achieved with the punch in engagement therewith to thereby positively maintain alignment between the punch and the die without regard for the angular orientation of the punch and die relative to a workpiece.

11 Claims, 2 Drawing Sheets

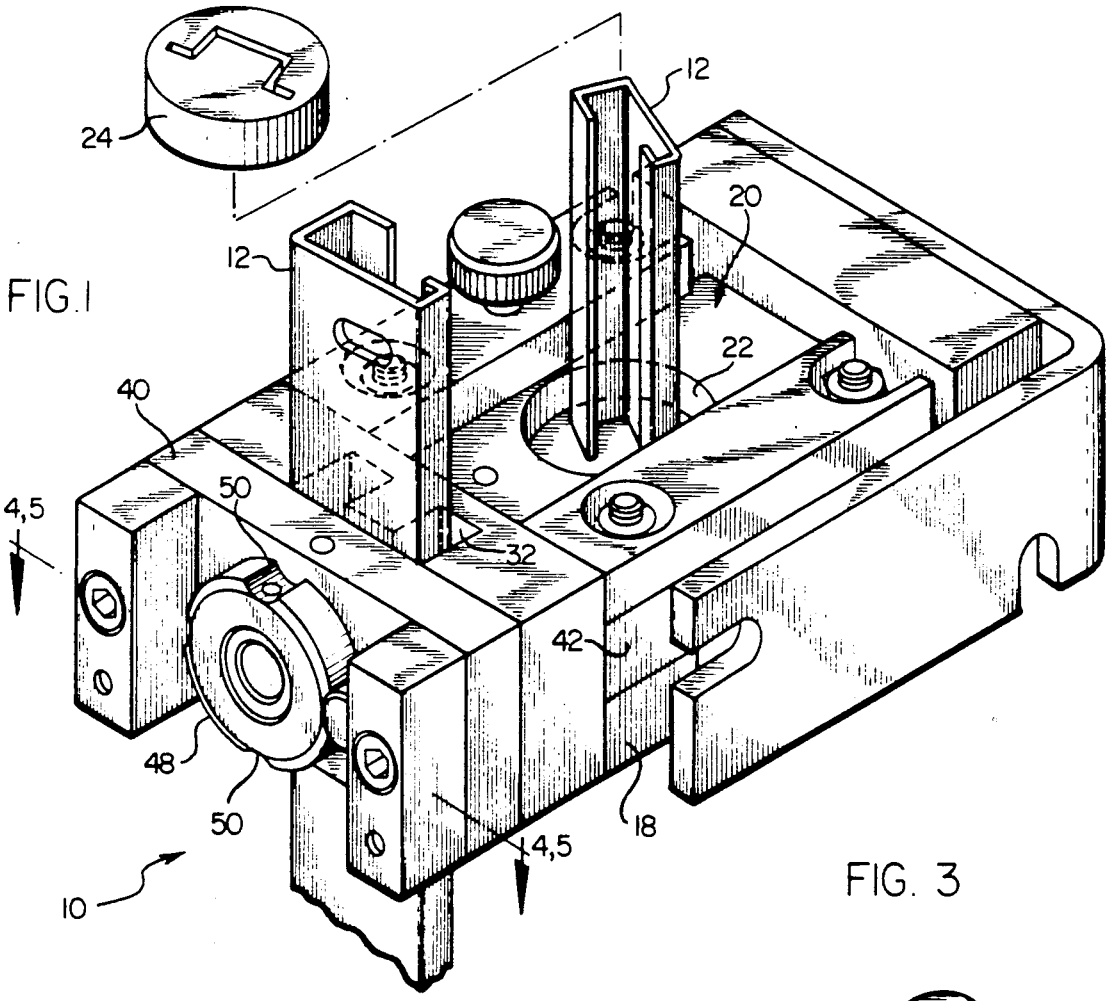
FIG.1
FIG. 3
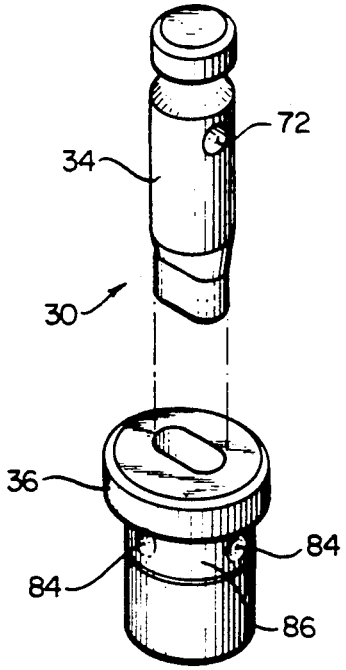
FIG. 2
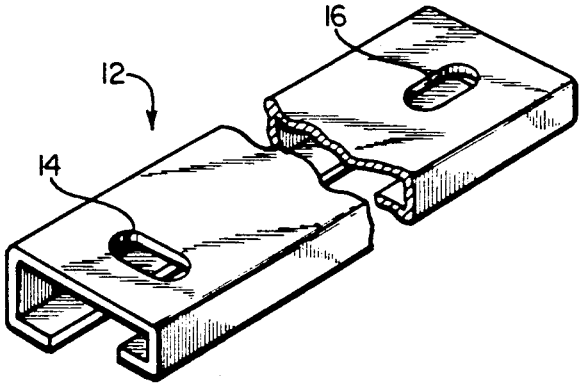

CUTTER FOR DIN RAIL

BACKGROUND OF THE INVENTION

The present invention is directed to the cutting and punching arts and more particularly to a novel and improved tool for cutting and punching a DIN rail and to a novel punch arrangement for such a tool.

DIN is a German industrial standards committee similar to SAE or AISI in the United States, for example. DIN rail is a mild steel, aluminum or copper channel shaped strip, usually produced by roll-forming and generally available in 8-10 foot lengths. The channel comes in a variety of cross-sectional shapes which are designed to provide a raised track or channel for fastening electrical components, such as switches, relays and circuit breakers into electrical panels.

Generally the 8-10 foot lengths are cut to the desired length, whereupon mounting slots are cut or punched adjacent opposite ends of the length of rail to facilitate mounting and alignment of the rail relative to an electrical panel or the like. The slots which are punched in the ends are somewhat oblong in shape to permit some play for achieving a desired alignment. Moreover, it is the usual practice to punch one of the slots in a generally horizontal orientation, that is, coaxial relative to the elongate rail; and the other slot in a generally vertical orientation—that is, generally perpendicular to the axis of the elongate rail. This generally perpendicular, relative alignment of the slots permits somewhat greater play in mounting the rail to achieve the desired alignment thereof.

A number of DIN rail cutter tools are available in Europe. However, there is room for improvement of these tools in a number of areas. For example, tools heretofore provided have generally been arranged for cutting only one or a limited number of configurations of DIN rail. One or more separate punches must then be used to punch the required slots. In contrast, we propose to provide a tool which may cut any of a plurality of different shapes or configurations of DIN rail, thus requiring but a single tool for the shop or industrial installer rather than a plurality of relatively large expensive tools to accommodate the several different shapes of DIN rail. We also propose a single tool including both cutting and punching portions.

Heretofore, assuring correct punching of the slots in the desired vertical and horizontal orientations at opposite ends of a length of rail has presented some problems. In particular, the punches and dies must be correctly aligned with each other for forming the slot. Hence, it has heretofore been the practice to provide separate punch and die sets which are oriented at the desired two orientations for punching the respective slots in the DIN rail. A particular problem with providing a single but rotatable die set is assuring that the operator will not rotate only the punch member or only the die member of the set and not the other. Should the operator misalign the punch and die during rotation or reorientation thereof, it will result in considerable damage to the tool if an attempt is made to punch a slot with the punch and die misaligned. Accordingly, we have devised a novel arrangement for a rotatable punch and die which may be rotated to a desired orientation and yet in which proper alignment of the punch and die is assured at all times.

OBJECTS AND SUMMARY OF THE INVENTION

Accordingly, it is a general object of this invention to provide a novel and improved tool for cutting and punching DIN rail.

A further object is to provide a novel punch and die assembly in which a single punch and die is capable of punching slots in at least two different orientations of a DIN rail, and in which proper alignment of the punch and die is assured at all times regardless of the angular orientation thereof relative to the DIN rail to be punched.

Another object is to provide a tool which performs both cutting and punching operations.

Yet another object is to provide a cutting tool with interchangeable cutting dies for cutting differently shaped DIN rails.

Briefly, and in accordance with the foregoing objects, a rotating punch and die set for punching a workpiece at any of a plurality of angular orientations comprises punch mounting means; punch means rotatably mounted in said punch mounting means; die mounting means; die means rotatably mounted in said die mounting means; means mounting said punch mounting means and said die mounting means for relative movement so as to advance and retract said punch means into and out of engagement with said die means; interlocking means for releasably interlocking with said die means for preventing rotation thereof; and release means for releasing said interlocking means in response to advancement of said punch means into engagement with said die means such that rotation of said die means can only be achieved with said punch means in engagement therewith to thereby positively maintain alignment between said punch means and said die means without regard for the angular orientation of the punch means and die means relative to a workpiece.

In accordance with another aspect of the invention, a DIN rail cutter and punching apparatus for cutting a DIN rail to a selected length and for punching at least one mounting slot therethrough at a desired angular orientation comprises shear means for cutting said DIN rail and a punch and die set which is operatively coupled for operation in unison with said shear means.

In accordance with yet another aspect of the invention, a DIN rail cutter for cutting a DIN rail to a selected length comprises shear means for cutting said DIN rail; and means for removably receiving a cutting die for accommodating any of a plurality of cutting dies for cutting different shapes of DIN rail.

BRIEF DESCRIPTION OF THE DRAWINGS

The features of the present invention which are believed to be novel are set forth with particularity in the appended claims. The organization and manner of operation of the invention, together with further objects and advantages thereof may best be understood by reference to the following description, taken in connection with the accompanying drawings in which like reference numerals identify like elements, and in which:

FIG. 1 is a perspective view of a combined cutting and punching tool in accordance with the invention;

FIG. 2 is a perspective view of one form of DIN rail which may be cut and punched by the apparatus of FIG. 1;

FIG. 3 is an exploded perspective view of a punch and die portion of the tool of FIG. 1;

DESCRIPTION OF THE ILLUSTRATED EMBODIMENT

Figure 4:
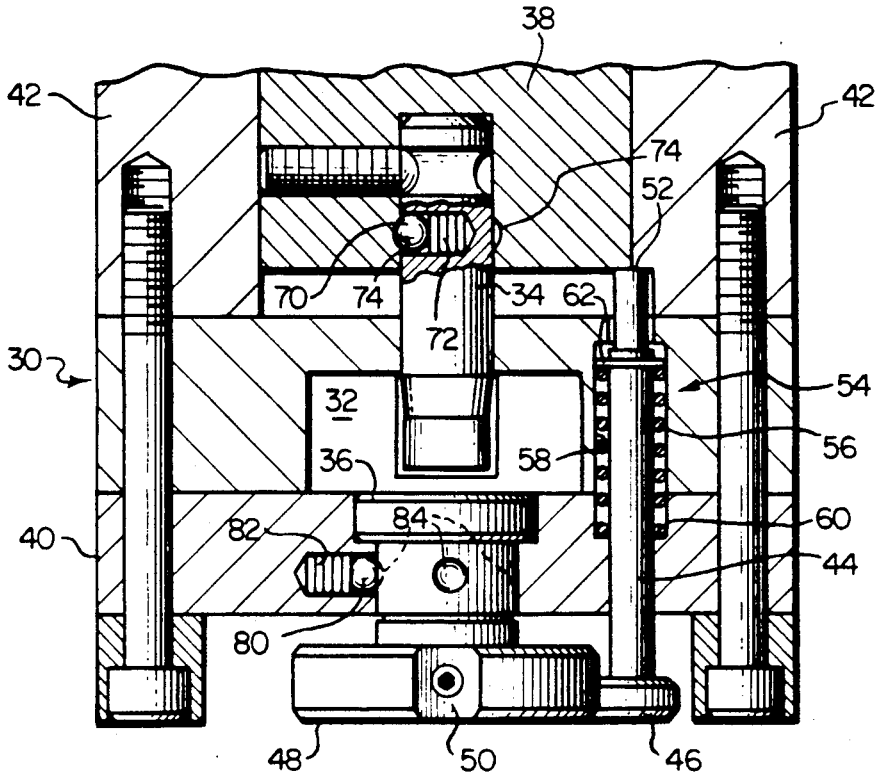
FIGS. 4 and 5 are somewhat simplified sectional views taken generally along the lines 4,5-4,5 of FIG. 1, and illustrating the punch and die components thereof in disengaged and engaged conditions, respectively.

Referring to the drawings, and initially to FIGS. 1 and 2, a combined cutting and punching tool 10 is provided for cutting a DIN rail 12 to a desired length and for punching one or more mounting apertures or slots 14, 16 therethrough. The DIN rail 12 is a generally elongate channel-shaped strip. Moreover, while the strip shown in FIG. 2 has a given cross-sectional channel shape, a number of other cross-sectional shaped DIN rails are also commonly available.

To this end, and in accordance with one aspect of the invention, the tool 10 includes a shearing means including a stationary shearing plate 18 and a movable shear plate 20. In accordance with one feature of the invention, the movable shear plate 20 includes an opening or chamber 22 for interchangeably mounting one of a plurality of different die plugs 24. Each die plug 24 has a die form or shape therein complementary with the cross-sectional shape of a differently shaped DIN rail member. Accordingly, the single tool as illustrated in FIG. 1 is capable of cutting any desired shape of DIN rail, by supplying a complementary shaped die plug 24 for use therewith.

The tool 10 may be activated by suitable mechanical means (not shown) such as a lever, a hydraulic tool or the like for providing the necessary amount of force to complete the shearing or punching operation with respect to a DIN rail 12. Thus either a mechanical handle, a hydraulic driver device, or a hand pump, hose and ram may be utilized to operate the tool 10 in accordance with the invention.

Figure 5:
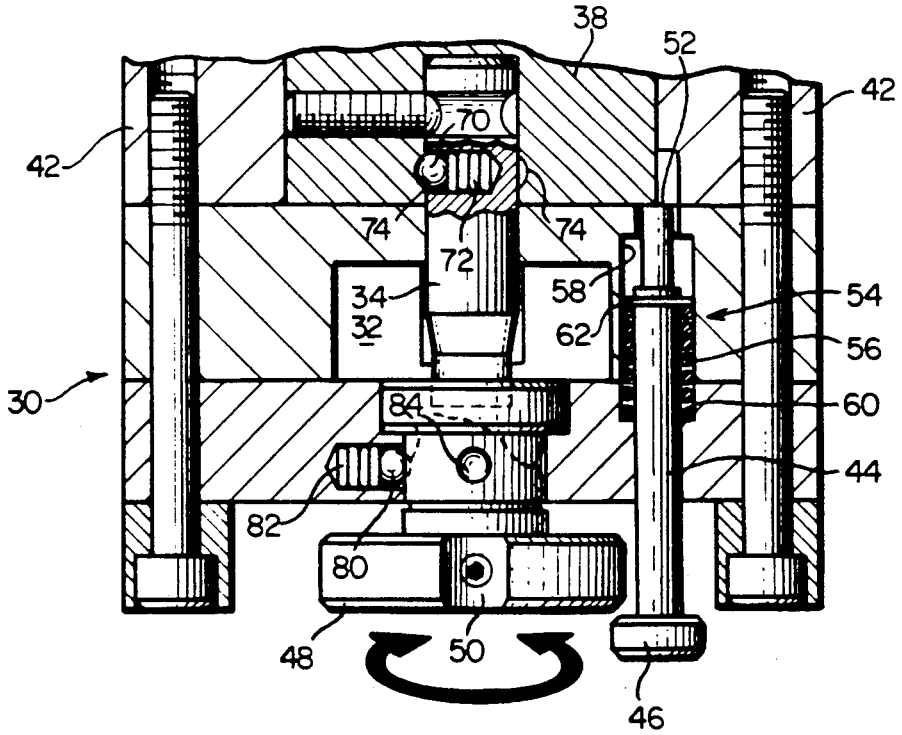

In accordance with a further feature of the invention, the tool 10 (in the preferred embodiment illustrated in FIG. 1) also includes a punch and die set 30, shown in further detail in FIGS. 3-5. Preferably, the punch and die set is coupled for operation in unison with the shear means, and in particular with the movable shear plate 20. Accordingly, the same tool 10 may be used to accomplish both the cutting operation and the punching of the slots 14, 16 with respect to a DIN rail such as DIN rail 12. It will be appreciated that the cutting and punching operations are preferably carried out separately. That is, a DIN rail may be cut to a desired length by the shearing portion of the tool 10, and may thereafter have suitable slots punched therethrough. However, these operations would not normally take place simultaneously. The illustration of DIN rail located in alignment with both the shearing portion and the punch and die portion of the tool shown in FIG. 1 is for purposes of illustration and description only, as such placement of DIN rail in both the punch and die set and the shear means would not normally occur simultaneously in use.

Turning now to FIGS. 3-5, and initially to FIG. 3, in accordance with another aspect of the invention, the punch and die set are rotatably mounted for punching the slots 14, 16 at different angular orientations. As mentioned hereinabove, it is usually desirable to punch elongate slots near opposite ends of a length of DIN rail which are oriented generally perpendicular with each other. This permits sufficient play to obtain a desired alignment of the DIN rail when mounting the same. In accordance with the present invention, a single punch and die set is rotatable to at least each of two mutually orthogonal positions with respect to a DIN rail-receiving through opening 32 therethrough for punching slots at these two orientations. This relationship is also diagrammatically indicated in FIG. 3, wherein the punch and die set are seen to include a punch or punch means 34 and a die or die means 36, which are rotatably mounted in a punch mounting means or block 38 and a die mounting means or block 40, respectively, as more fully shown in FIGS. 4 and 5.

Additional means including respective side rails and/or uprights 42, 42 mount the punch mounting block 38 for slidable movement for advancing and retracting punch 34 for engagement and disengagement with the die 36. When moving into engagement with die 36, the punch traverses the DIN rail opening 32, thereby punching a DIN rail which has been placed therein. In the illustrated embodiment, the DIN rail opening 32 is of a universal configuration for receiving DIN rails of many different cross-sections interchangeably.

In accordance with a feature of the invention, interlocking means in the form of an elongate pin 44 are provided for normally interlocking with the die or die means 36 for preventing rotation thereof. Pin 44 also defines release means for releasing this interlocking condition with the die only in response to advancement of the punch 34 into engagement with the die 36. Hence the arrangement is such that rotation of the die can only be achieved when the punch and die are engaged which thereby positively maintains the required alignment between the punch and die at all times, irrespective of their angular position relative to the DIN rail to be punched. This relationship is indicated generally in FIGS. 4 and 5, which will now be described in somewhat further detail.

As more fully shown in FIGS. 4 and 5, the pin member 44 has an enlarged head or interlocking portion 46 which is configured for engaging one of a plurality of complementary formed locking surfaces or recesses 50 in a knob portion 48 of the die means 36. This knob portion 48 projects from the tool for gripping and rotation by an operator. However, the engagement of the head 46 with one of the slots or recesses 50 normally prevents such rotation. In the illustrated embodiment, since it is desired to punch slots in the DIN rail at orientations spaced by 90°, four such slots or locking recesses or surfaces 50 are formed at 90° intervals about the periphery of the knob 50. However, fewer or more such recesses and corresponding locking positions may be provided without departing from the principals of the invention.

The release means is generally defined by a release surface 52 which comprises an end surface of the pin 44 at the end thereof opposite the head 46. Additionally, a biasing arrangement or biasing means designated generally by the reference numeral 54 is provided for biasing the release surface 52 into engagement with the punch mounting means or block 38, and for simultaneously biasing the interlocking portion or head 46 into engagement with one of the locking surfaces 50 of the knob 48.

In the illustrated embodiment, this biasing means takes the form of a compression spring 56 which is mounted in a bore 58 coaxially surrounding the body of the pin 44. The spring bears against a lower end surface 60 of this bore, and at its opposite end bears against a retaining ring 62 which is attached to the body of the pin 44. It will be appreciated that other suitable biasing means may be utilized without departing from the invention. Hence, the pin member 44 extends through the die mounting means or block 40, such that its release or end surface 52 is in engagement with the punch mounting means or block 38 at all times. Moreover, the length of the pin is selected such that the stroke of the punch is substantially similar to the amount of movement of the interlocking head portion 46 necessary to disengage the same from the cooperating locking surface or recess 50 of the knob 48.

In accordance with the preferred embodiment illustrated herein, additional detent means are provided for defining a plurality of discrete angular positions in the rotation of the punch 34 and die 36. With respect to the punch 34, this detent means includes a spring-loaded ball member 70 which is carried in a radial bore 72 formed in the body of the punch. This ball cooperatively engages for releasable detenting action with one of four complementary recesses 74 which are located at 90° angularly spaced intervals about the periphery of the punch 34. The recesses 74 are located such that the ball 72 will engage one of these recesses simultaneously with engagement of one of the recesses or locking surfaces 50 with the head 46 of the pin 44 as the knob 48 is rotated. It will be remembered that rotation of the knob 48 necessarily causes corresponding rotation of both the die 36 and the punch 34 in unison.

Similarly, the detent means provided for the die 36 includes a spring-loaded ball member 80 which is mounted in a bore 82 in the die mounting means or block 40. Cooperatively, a peripheral circumferential surface of the die 36 is formed with a plurality of complementary recesses 84 for releasably engaging the ball 82 as the die is rotated relative thereto. These recesses 84 are also four in number and are spaced by 90° of arc about the surface 83. Moreover, it will be noted that the recesses 84 are aligned such that they are in the same angular positions as the locking surfaces or recesses in knob 50.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined, by the appended claims and equivalents thereof. Accordingly, the aim in the appended claims is to cover all such changes and modifications as fall within the true spirit and scope of the invention.

The invention is claimed as follows:

1. A rotating punch and die set for punching a workpiece at any of a plurality of angular orientations, comprising:

punch mounting means;

punch means rotatably mounted in said punch mounting means;

die mounting means;

die means rotatably mounted in said die mounting means;

means mounting said punch mounting means and said die mounting means for relative movement so as to advance and retract said punch means into and out of engagement with said die means;

interlocking means for releasably interlocking with said die means for preventing rotation thereof;

and release means for releasing said interlocking means in response to advancement of said punch means into engagement with said die means such that rotation of said die means can only be achieved with said punch means in engagement therewith to thereby positively maintain alignment between said punch means and said die means without regard for the angular orientation of the punch means and die means relative to a workpiece.

2. Apparatus according to claim 1 and further including detent means to define a plurality of discrete angular orientations of said punch means and of said die means relative to a workpiece.

3. Apparatus according to claim 1 wherein said interlocking means and said release means are defined by an elongate pin member having an interlocking portion for releasably engaging said die means and a release surface and biasing means for biasing said release surface into engagement with said punch mounting means and for simultaneously biasing said interlocking portion into engagement with said die means such that advancement of said punch means causes said punch mounting means to overcome said biasing means and disengage said interlocking portion from said die means when said punch means has advanced into engagement with said die means.

4. Apparatus according to claim 3 wherein said die means includes a knob portion for rotating said die means relative to said die mounting means.

5. Apparatus according to claim 4 wherein said knob portion has a plurality of cooperating locking surfaces for engaging said interlocking portion of said elongate pin member to define a plurality of angular positions of said punch means and said die means relative to a workpiece.

6. Apparatus according to claim 5 wherein said elongate pin member has an enlarged head portion at one end comprising said interlocking portion and configured for complementary engagement with said cooperating locking surfaces of said knob portion and wherein said release surface is located at an opposite end of said elongate pin member.

7. Apparatus according to claim 6 wherein said pin member extends through said die mounting means and wherein said biasing means comprises spring means for biasing said pin member in the direction of said punch mounting means, such that said release surface is engaged at all times with said punch mounting means, and wherein the length of said pin is selected such that the stroke of said punch means is substantially similar to the amount of movement of said interlocking head portion of said pin necessary to disengage the same from said cooperating locking surfaces of said knob portion.

8. Apparatus according to claim 1 wherein said die means includes a knob portion for rotating said die means relative to said die mounting means.

9. Apparatus according to claim 8 wherein said knob portion has a plurality of angularly spaced cooperating locking surfaces for engaging said interlocking means to define a plurality of angular positions of said punch means and said die means relative to a workpiece.

10. A rotating punch and die set for punching a workpiece at any of a plurality of angular orientations, comprising:

a punch mounting block;

a punch rotatably mounted in said punch mounting block;

a die mounting block;

a die rotatably mounted in said die mounting block;

said punch mounting block and said die mounting block being further mounted for relative movement so as to advance and retract said punch into and out of engagement with said die;

an interlocking member for releasably interlocking with said die for preventing rotation thereof;

and a release means for releasing said interlocking member in response to advancement of said punch into engagement with said die such that rotation of said die can only be achieved with said punch in engagement therewith to thereby positively maintain alignment between said punch and said die without regard for the angular orientation of the punch and die relative to a workpiece.

11. A rail cutter and punching apparatus for cutting a rail to a selected length and for punching at least one mounting slot therethrough at a desired angular orientation and comprising:

shear means for cutting said rail and a punch and die set which is operatively coupled for operation in unison with said shear means; punch mounting means; punch means rotatably mounted in said punch mounting means; die mounting means; die means rotatably mounted in said die mounting means;

means mounting said punch mounting means and said die mounting means for relative movement so as to advance and retract said punch means into and out of engagement with said die means;

interlocking means for releasably interlocking with said die means for preventing rotation thereof;

and release means for releasing said interlocking means in response to advancement of said punch means into engagement with said die means such that rotation of said die means can only be achieved with said punch means in engagement therewith to thereby positively maintain alignment between said punch means and said die means without regard for the angular orientation of the punch means and die means relative to a workpiece; wherein said apparatus includes means for removably receiving a cutting die, for accommodating any one of a plurality of cutting dies interchangeably for cutting different shapes of rail.

* * * * *